US005855238A

United States Patent [19]

Pleschiutschnigg et al.

[11] Patent Number: 5,855,238

[45] Date of Patent: Jan. 5, 1999

[54] PROCESS AND DEVICE FOR THE CONTINUOUS PRODUCTION OF SHEET METAL STRIPS

[75] Inventors: Fritz-Peter Pleschiutschnigg, Duisburg; Ingo Von Hagen, Krefeld, both of Germany

[73] Assignee: Mannesmann Aktiengesellschaft, Düsseldorf, Germany

[21] Appl. No.: 894,466

[22] PCT Filed: Feb. 5, 1996

[86] PCT No.: PCT/DE96/00210

§ 371 Date: Nov. 7, 1997

§ 102(e) Date: Nov. 7, 1997

[87] PCT Pub. No.: WO96/27464

PCT Pub. Date: Sep. 12, 1996

[30] Foreign Application Priority Data

Mar. 7, 1995 [DE] Germany ..... 195 09 681.9

[51] Int. Cl.[6] ..... B22D 23/04

[52] U.S. Cl. ..... 164/461; 118/58; 118/405; 164/415; 164/419; 164/475; 427/431; 427/434.7; 427/436

[58] Field of Search ..... 164/461, 419, 164/475, 415; 427/431, 434.7, 436; 118/58, 405

[56] References Cited

U.S. PATENT DOCUMENTS

| | | | |
|---|---|---|---|
| 3,470,939 | 10/1969 | Coad | 164/461 X |
| 3,561,399 | 2/1971 | Federman | 164/461 X |
| 3,568,753 | 3/1971 | Clarke | 164/461 |

FOREIGN PATENT DOCUMENTS

| | | | |
|---|---|---|---|
| 57-97862 | 6/1982 | Japan | 164/461 |
| 57-175069 | 10/1982 | Japan | 164/475 |
| 61-17351 | 1/1986 | Japan | 164/461 |
| 62-11944 | 3/1987 | Japan | 164/461 |
| 62-148073 | 7/1987 | Japan | 164/461 |
| 1-237069 | 9/1989 | Japan | 164/461 |
| 582042 | 11/1977 | U.S.S.R. | 164/461 |

*Primary Examiner*—J. Reed Batten, Jr.
*Attorney, Agent, or Firm*—Cohen, Pontani, Lieberman & Pavane

[57] ABSTRACT

A mother strip with a metallically pure surface is passed through a melt bath of a metal and whereby the coating is smoothed by rolling immediately after leaving the melt bath. The mother strip, having been preheated, to a temperature clearly above ambient temperature, especially above 200° C., is introduced into the metal bath. The preheating is carried out by indirect heat exchange with the melt bath in an oxygen-free environment. The melt freshly supplied to the melt bath has an increased temperature in accordance with the heat lost due to preheating.

25 Claims, 2 Drawing Sheets

PROCESS AND DEVICE FOR THE CONTINUOUS PRODUCTION OF SHEET METAL STRIPS

BACKGROUND OF THE INVENTION

1. Field of the Invention

The invention relates to a process for the continuous production of sheet metal strips, particularly of steel, as well as to a device to implement this process.

2. Description of the Prior Art

EP 0 311 602 B1 discloses a process for producing thin metal strands, e.g., of steel, with a thickness under 20 mm. In this process, a metallically pure steel strip (mother strip), whose surface is at ambient temperature, is passed vertically through a metal bath from bottom to top or top to bottom. The metal bath can consist of the same material as the mother strip or of material that differs from the mother strip. The retention time of the mother strip in the metal bath is determined as a function of bath temperature so that metal crystals are formed and melt is deposited on the surface of the mother strip, without the mother strip itself melting or already deposited material remelting. In this way, it is possible to produce a strip-type semifinished product with a thickness roughly 6 to 10 times that of the original mother strip. In this process, in contrast to standard continuous casting, solidification occurs not from the outside to the inside, but rather in the opposite direction. For this reason, this form of production of semifinished products is sometimes referred to as inversion casting.

WO 94 29 048 discloses another inversion casting process, in which a thin steel strip is passed through a steel melt from bottom to top and then, upon emerging from the melt, is immediately smoothed on its surface by means of a pair of smoothing rollers. After the smoothing roller pair, the steel strip passes through a cooling zone filled with inert gas, where the strip is cooled in a controlled fashion to improve its material properties.

Because the object of inversion casting is generally to crystallize as much material as possible on the mother strip, the mother strip is usually introduced into the melt at ambient temperature. However, it is not necessarily desirable, particularly when producing metal strips with layers of different materials (composite materials), to attain the greatest possible coating thickness. In the case of composite materials, it is often desirable to produce considerably smaller layer thicknesses, instead of products roughly 3 to 6 times as thick as the mother strip. This can be done by drastically reducing the contact time between the melt and the mother strip. When this is done, however, the bond between the crystallized material and the mother strip is often inadequate, so that complete bonding does not occur with the required reliability. To reduce the growth rate on the surface of the mother strip and, at the same time, still ensure good bonding between the mother strip and the crystallized material, the mother strip can be preheated, so as to lessen its cooling capacity and thus its crystallization potential. This procedure can be used, in particular, to produce multilayered materials (e.g., carbon steel coated with stainless steel).

It is possible to preheat the mother strip to a particular desired temperature prior to its entry into the melt by arranging a suitable preheating furnace in the form of a continuous furnace in front of the melt container as a separate aggregate. Such furnaces can be heated with fossil energy carriers (e.g., gas or oil) or electrical energy (e.g., an induction furnace). The use of a plasma burner is also conceivable.

Solutions of this type entail relatively high additional equipment expenses, especially since the forward motion speeds for the mother strip are quite high, usually between 10 and 100 m/min. Furthermore, the mother strip introduced into the melt must have a metallically pure surface. This means that preheated mother strips, in particular, must be protected against oxygen, because otherwise re-oxidation will rapidly begin. Oxidized surface areas would jeopardize the required bonding with the crystallized material.

SUMMARY OF THE INVENTION

The object of the invention is to provide a process, and a device for its implementation, with which it is possible to deliberately preheat the mother strip to a preheated temperature clearly above ambient temperature (in particular, over 200° C.) without incurring large equipment expenses and without creating the risk of re-oxidation of the mother strip surface.

Pursuant to this object, and others which will become apparent hereafter, one aspect of the present invention resides in a process for continuously producing sheet metal strip, which comprises the steps of preheating the mother strip to a temperature over 200° C. by indirect heat exchange with a metal melt bath in an oxygen-free environment, passing the mother strip through the melt bath, supplying fresh molten metal to the melt bath and increasing the temperature of the fresh molten metal in accordance with heat loss due to preheating, regulating the speed of the mother strip as a function of immersion length in the melt bath and temperature of the metal melt for attaining a desired total thickness of a coating deposited on the surface of the mother strip as crystals and melt, and smoothing the coating with rollers immediately after leaving the melt bath.

Another aspect of the invention resides in a device for continuously producing sheet metal strip, which device comprises a melt container having an outer wall, a sealing device arranged in a region of the outer wall of the melt container so that a mother strip is passable into and out of the melt container, forward transport means for transporting the mother strip in a transport direction, and rolling means for smoothing a crystallized coating on the mother strip. The sealing device includes a substantially cuboid-shaped housing arranged to extend into the melt container in the transport direction of the mother strip. The housing has broad sides that run parallel to a plane of the mother strip and are made of a refractory-grade material. The broad side walls are configured to surround the mother strip as radiant heat surfaces and so as to form a through channel. The inventive device further includes means, attached to the sealing device, for maintaining an oxygen-free atmosphere in a region of the through-channel.

In the process according to the invention, the mother strip, after production of its metallically pure surface and before being introduced into the melt bath, is heated to a temperature clearly above ambient temperature. The preheated temperature should be at least 200° C., preferably at least 300°, and especially preferably at least 400° C. If necessary, the preheated temperature can even be substantially higher. The preheating is carried out by indirect heat exchange; specifically, using the heat of the metal bath used for crystallization. No direct contact between the melt and the mother strip occurs, however. To avoid re-oxidation of the mother strip surface, there is an oxygen-free atmosphere at least in the area of the heating zone. This atmosphere can be maintained by producing a suitable vacuum, for example. In most cases, however, it is advantageous to use a protective gas atmosphere. The protective gasses that can be used include, in particular, argon and, in some cases, nitrogen. The preheated mother strip is then passed through the metal bath in a manner known per se, so that crystallization and the entrainment of molten melt occurs on the surface of the mother strip. The thickness of the desired coating on the mother strip can be adjusted by regulating the forward speed of the mother strip, taking into account the length of the submersion distance in the metal melt as well as the melt temperature. Advantageously, the crystallized coating is smoothed immediately after leaving the melt bath. The heat needed to preheat the mother strip is taken from the melt bath, a fact that must be considered in adjusting the temperature of melt freshly conveyed into the melt bath. The temperature of the fresh melt must be set higher than if preheating were carried out in a separate upstream heating aggregate (e.g., a continuous furnace).

The process is used to special advantage for coating mother strips of standard carbon steel. The metal melt can consist of the same type of material as the strip. However, it is especially advantageous to use a metal bath of a different material than the mother strip. In particular, the use of higher-alloy materials for the metal bath is recommended. The thickness of the mother strip used should, as far as possible, be less than 3 mm, preferably less than 2 mm and especially preferably less than 1 mm. The thinner the material used, the faster its preheating can take place. This means that the preheating section can be shortened or that a higher preheated temperature can be achieved with a preheating section of the same length.

In a preferred embodiment, the mother strip is passed through the melt bath from bottom to top. However, it is also possible for the mother strip to be passed from top to bottom or to be moved into and out of the melt bath laterally. When the mother strip passes through the melt bath from bottom to top, no molten melt should emerge to the outside at the point where the mother strip enters the melt. The entry passage at this point is shaped like a narrow slit, and is filled to the greatest possible extent by the cross-section of the mother strip. A clear temperature gradient occurs in the vicinity of the entry zone, due to the cooling effect of the mother strip. The area of the melt near the entry point of the mother strip is often referred to as the "meniscus." To avoid expensive sealing measures at this point, it is advantageous to set the temperature of the freshly introduced melt, taking into account the heat lost by preheating the mother strip, so that the melt bath in the vicinity of the entry point of the mother strip has an isotherm that lies between the liquidus temperature $T_{liq}$ and the solidus temperature $T_{sol}$. Under these conditions, sealing can be achieved without any problem.

BRIEF DESCRIPTION OF THE DRAWINGS

The invention is described in greater detail below in reference to the drawings. The drawings show.

DETAILED DESCRIPTION OF THE PREFERRED EMBODIMENTS

Figure 1:
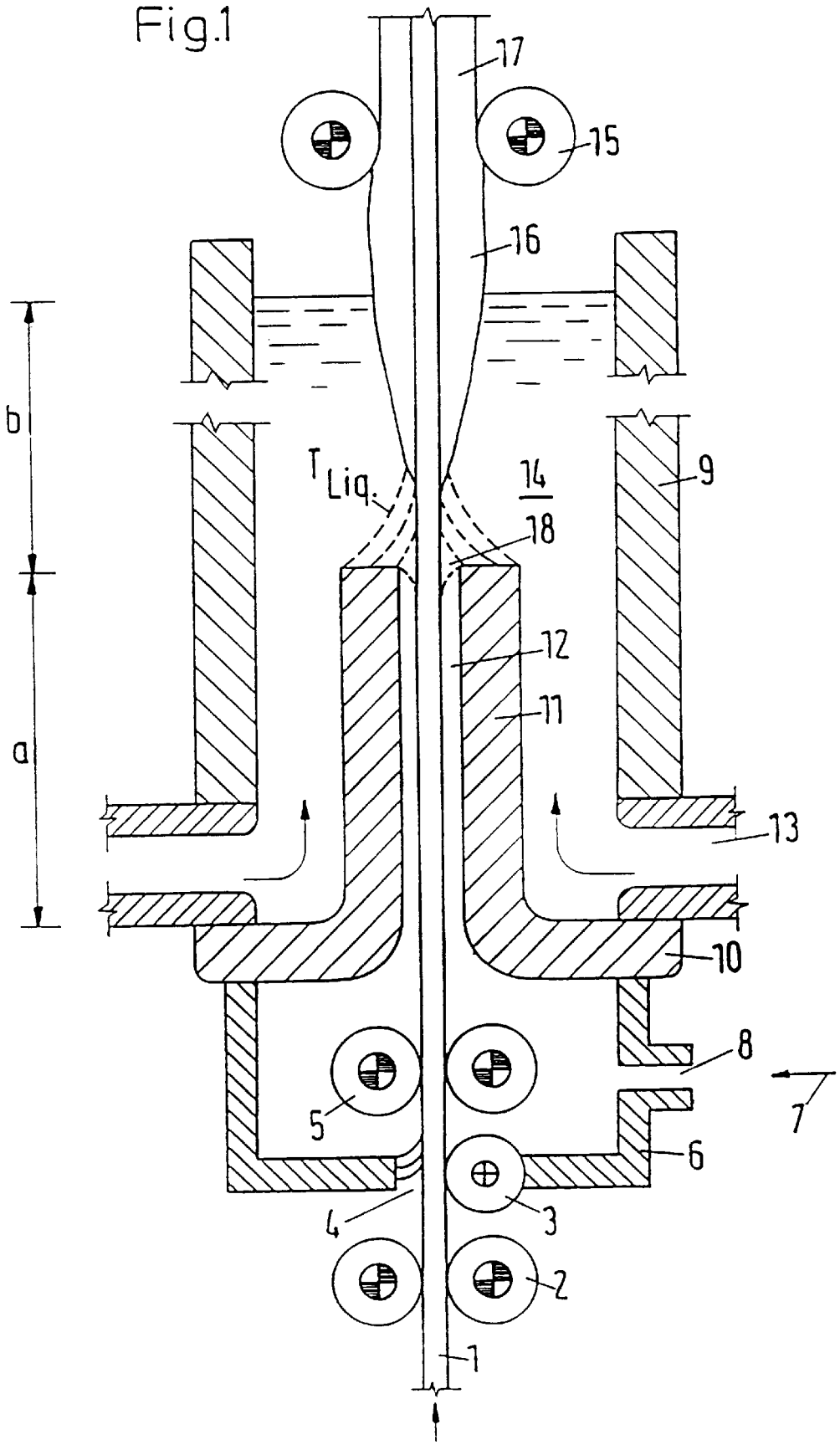
FIG. 1 is a longitudinal section through an example of a device according to the invention.

FIG. 1 shows, in schematic fashion, a possible embodiment of a device according to the invention. This drawing is not to scale; specifically, the length of the mother strip in relation to its thickness is not realistic.

The device comprises a melt container 9, whose bottom is formed by a sealing device 10. Of course, the melt container 9 could also be equipped with its own bottom, in which the sealing device 10 is then installed. The sealing device 10 consists substantially of a plain housing with a somewhat cuboid-shaped interior space corresponding to the cross-sectional geometry of the mother strip 1 to be coated. The broadside walls of the sealing device 10 are indicated by reference number 11. The interior space of the sealing device 10 is open at the bottom and the top, so as to constitute a narrow through-channel for the passage of the mother strip 1. At least the broadside walls 11 are made of refractory-grade material resistant to the metal melt 14 to be used. Advantageously, this refractory-grade material should be selected so as to have the highest possible heat conductivity, because the broadside walls are meant to act as the radiant heating surfaces of a heat exchanger. In principle, it would be possible to extend the broadside walls 11 over the entire breadth of the melt container 9, so that in the extreme case, the narrow lateral surfaces, past which the longitudinal edges of the mother strip 1 run, would be omitted. A shielding box 6 is flanged on tightly below the sealing device 10. This shielding box 6 has a gas connection pipe 8, through which an inert gas under overpressure can be fed into the interior of the shielding box 6 (Arrow 7). In an advantageous further embodiment of the invention, a special sealing system is provided to prevent unnecessarily high leakage losses when the inert gas is fed in. This special sealing system is located on the shielding box 6 in the area of the slit for the mother strip 1. This sealing system can be embodied, for example, in the form of a pair of elastic sealing rollers 3 (preferably of hard rubber) or a lamella seal 4. To introduce the mother strip 1 into the metal melt 14 located in the melt container 9, the mother strip is moved forward vertically from bottom to top by means of driving roller pairs 2, 5. The metal melt 14 is fed into the melt container 9 through several melt inflow pipes 13, which are located near the lower part of the sealing device 10. The exit openings of the inflow pipes 13 are directed toward the broadside walls 11, as indicated by the arrows. The broadside walls 11 are heated to a suitably high temperature by direct contact with the metal melt 14. As a result, the through-channel 12 is turned into a heating through-channel for the mother strip 1. Extraordinarily rapid heating of the mother strip 1 takes place due to the intensive heat radiation of the broadside walls 11. This effect can be easily assessed on the basis of the chart in FIG. 2.

Figure 2:
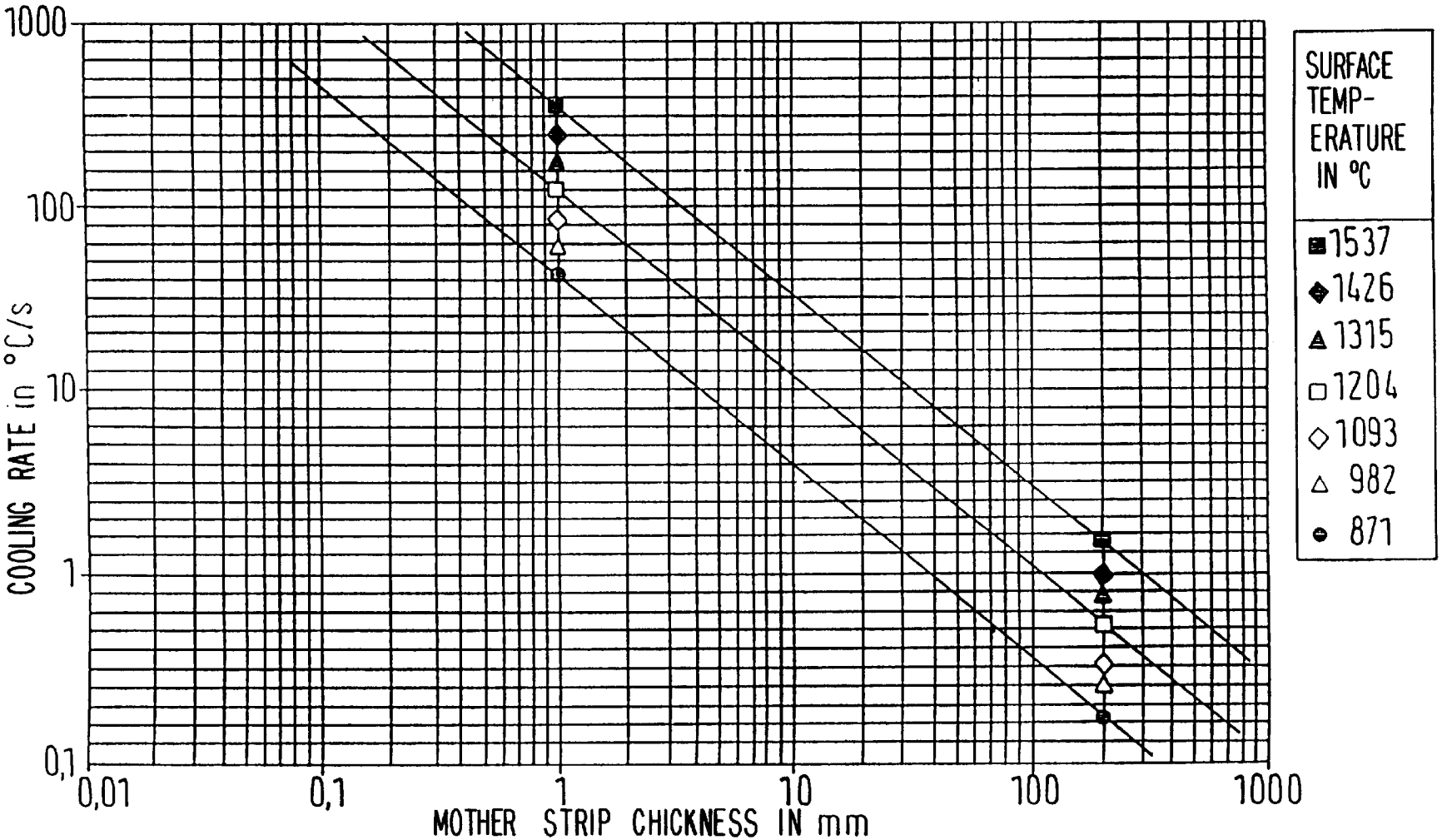
FIG. 2 shows the cooling speed of sheet metal and plates of steel by heat radiation, as a function of the thickness and surface temperature of the material.

FIG. 2 shows the speed of cooling, by heat emission, for semifinished products of steel in strip or plate form as a function of the surface temperature and thickness of the products. Conversely, this graph also provides information about the heating rate when corresponding products of ambient temperature are heated by a radiant heat source with a surface temperature as indicated. Thus, a 1 mm thick steel strip is heated at a rate of approximately 250° C./second given a radiation temperature of e.g. 1426° C. When the length of the through-channel, and thus of the preheating section, is a =1 m and the forward speed of the mother strip is 60 m/second, the mother strip can be heated by approximately 250° C. before entering the melt bath 14 given a radiation temperature of the broadside walls of approximately 1426° C. and a strip thickness of 1 mm. The preheating temperature to be set can thus be influenced by the embodiment of the through-channel length a. If the thickness of the mother strip is reduced and the through-channel length a remains the same, a higher temperature would be set. Thus, in keeping with FIG. 2, given a radiation temperature of 1426° C. and a mother strip thickness of 0.8 mm, a temperature increase of approximately 316° C. results at a retention time of 1 second in the through-channel 12 (corresponding to a forward speed of 60 m/second and a through-channel length of 1 m).

Shortly after the mother strip 1 enters the metal melt 14, the crystallization of the melt begins, growing into the coating identified by reference number 16. To smooth the surface of the produced coated product, a smoothing roller pair 15 is advantageously placed directly above the melt bath 14. The coated strip with a smoothed surface is indicated by reference number 17. The thickness of the attainable coating 16 depends not only on the preheating temperature, but also, to a substantial extent, on the duration of the contact between the mother strip 1 and the metal melt 14. In turn, the contact time depends on the forward speed of the mother strip 1 and the length of the submersion distance b. The aforementioned meniscus that forms in the region where the mother strip 1 enters the metal bath 14 is identified by reference number 18. Several isotherms are shown in the form of dashed lines. The isotherm at the liquidus temperature is designated $T_{liq}$. In some cases, to prevent an emergence of the melt, it can be advantageous to design the opening of the through-channel 12 more narrowly in the exit area of the mother strip 1 than over the rest of the through-channel length a. This should be at least 0.5 m, advantageously at least 1 m, so that a sufficiently high preheating temperature can be reached at an adequately high forward speed.

The invention makes it possible to produce thin coatings on a mother strip with reliable bonding to the base material, without requiring that space-consuming separate heating aggregates be used for this purpose.

Instead, the mother strip is preheated directly in front of the entrance to the metal melt by means of indirect heat exchange with the melt.

We claim:

1. A process for the continuously producing sheet metal strip, comprising the steps of:

preheating a mother strip with a metallurgically pure surface to a temperature over 200° C. by indirect heat exchange with a metal melt bath in an oxygen-free environment;

passing the mother strip through the melt bath;

supplying fresh molten metal to the melt bath and increasing temperature of the fresh molten metal in accordance with heat loss due to preheating;

regulating speed of the mother strip as a function of immersion length in the melt bath and temperature of the metal melt for obtaining a desired total thickness of a coating deposited on the surface of the mother strip as crystals and melt; and smoothing the coating with rollers immediately after leaving the melt bath.

2. A process as defined in claim 1, wherein the mother strip is passed through the melt bath from bottom to top.

3. A process as defined in claim 1, wherein the oxygen-free environment comprises an atmosphere of an inert gas maintained with slight overpressure.

4. A process as defined in claim 3, wherein the inert gas is one of argon and nitrogen.

5. A process as defined in claim 1, wherein the mother strip is preheated to at least 300° C.

6. A process as defined in claim 5, wherein the mother strip is preheated to at least 400° C.

7. A process as defined in claim 1, wherein the mother strip is a material that consists of a standard carbon steel.

8. A process as defined in claim 1, wherein the metal melt comprises the same material as the mother strip.

9. A process as defined in claim 1, wherein the metal melt comprises a higher-alloy steel material than the mother strip material.

10. A process as defined in claim 1, wherein the mother strip has a thickness of less than 3 mm.

11. A process as defined in claim 10, wherein the mother strip has a thickness of less than 2 mm.

12. A process as defined in claim 11, wherein the mother strip has a thickness of less than 1 mm.

13. Process as defined in claim 1, wherein the step of increasing the temperature of molten metal freshly supplied to the melt bath includes setting the temperature of the freshly added melt, taking into account heat emission for preheating the mother strip, so that the melt bath in a vicinity of an entrance point of the mother strip into the metal melt has an isotherm that lies between a liquidus temperature $T_{liq}$ and a solidus temperature $T_{sol}$.

14. A device for continuously producing sheet metal strip, comprising:

a melt container having an outer wall;

a sealing device arranged in a region of the outer wall of the melt container so that a mother strip is passable into and out of the melt container;

forward transport means for transporting the mother strip in a transport direction;

rolling means for smoothing a crystallized coating on the mother strip, the sealing device including a substantially cuboid-shaped housing arranged to extend into the melt container in the transport direction of the mother strip, the housing having broad-side walls that run parallel to a plane of the mother strip and are of a refractory-grade material, the broad-side walls being configured to surround the mother strip as radiant heat surfaces and so as to form a through-channel; and means, attached to the sealing device, for maintaining an oxygen-free atmosphere in a region of the through-channel.

15. A device as defined in claim 14, wherein the sealing device is arranged in a bottom area of the melt container, the transport means is operative to convey the strip vertically upward.

16. A device as defined in claim 14, wherein the sealing device is formed of a refractory-grade material having a relatively high heat conduction coefficient.

17. A device as defined in claim 16, and further comprising means, provided near the bottom of the melt container, for feeding metal melt into the melt container.

18. A device as defined in claim 17, wherein the feeding means includes a plurality of melt inflow pipes with exits directed toward a lower region of the broadside walls.

19. A device as defined in claim 14, wherein the means for maintaining an oxygen-free atmosphere is an inert gas shield.

20. A device as defined in claim 19, wherein the insert gas shield includes a shielding box arranged and configured to overarch the entrance area for the mother strip on the through-channel, and a gas connection pipe, connected to the shielding box so as to supply inert gas under slight overpressure, the shielding box having a slit-like opening into which the mother strip is insertable.

21. A device as defined in claim 20, and further comprising means for sealing the slit-like opening of the shielding box.

22. A device as defined in claim 21, wherein the sealing means includes a lamella seal.

23. A device as defined in claim 21, wherein the sealing means includes a pair of elastic sealing rollers.

24. A device as defined in claim 14, wherein the sealing device is configured and arranged to extend at least 0.5 m, into the melt container.

25. A device as defined in claim 14, wherein the through-channel is configured to form an opening in an exit area of the mother strip that is narrower than a remaining region over a length of the through-channel.

* * * * *